United States Patent [19]

Rule

[11] 4,013,383

[45] * Mar. 22, 1977

[54] VERTICAL SHAFT IMPELLER PUMP APPARATUS

[75] Inventor: Clinton Rule, Beverly Farms, Mass.

[73] Assignee: Rule Industries, Inc., Gloucester, Mass.

[ * ] Notice: The portion of the term of this patent subsequent to Jan. 21, 1992, has been disclaimed.

[22] Filed: Nov. 29, 1974

[21] Appl. No.: 528,029

Related U.S. Application Data

[63] Continuation of Ser. No. 420,933, Dec. 3, 1973, Pat. No. 3,861,831.

[52] U.S. Cl. ..... 417/366; 417/424

[51] Int. Cl.[2] ..... F04B 17/00; F04B 39/06; F04B 35/04

[58] Field of Search ..... 417/424, 366, 372, 435, 417/359, 361

[56] References Cited

UNITED STATES PATENTS

| | | | |
|---|---|---|---|
| 3,055,304 | 9/1962 | Ziegler | 417/424 |
| 3,056,911 | 10/1962 | Hart et al. | 417/424 |
| 3,179,058 | 4/1965 | Meagher | 417/424 |
| 3,256,828 | 6/1966 | Rule | 417/424 |
| 3,264,999 | 8/1966 | Tutthill | 417/424 |
| 3,407,739 | 10/1968 | Myers | 417/424 |
| 3,407,747 | 10/1968 | Rule | 417/424 |
| 3,408,942 | 11/1968 | Davenport et al. | 417/424 |
| 3,494,291 | 2/1970 | Carter | 417/424 |
| 3,575,521 | 4/1971 | Porter et al. | 417/435 |
| 3,652,186 | 3/1972 | Carter | 417/424 |
| 3,719,429 | 3/1973 | Rule | 417/424 |
| 3,752,603 | 8/1973 | Bunch | 417/424 |
| 3,767,321 | 10/1973 | Layne | 417/424 |
| 3,771,926 | 11/1973 | Pardieck | 417/424 |
| 3,861,831 | 1/1975 | Rule | 417/424 |

FOREIGN PATENTS OR APPLICATIONS

| | | | |
|---|---|---|---|
| 446,424 | 1/1948 | Canada | 417/424 |
| 181,613 | 3/1936 | Switzerland | 417/424 |

*Primary Examiner*—Carlton R. Croyle
*Assistant Examiner*—Donald S. Holland
*Attorney, Agent, or Firm*—William N. Anastos

[57] ABSTRACT

There is disclosed vertical shaft impeller pump apparatus especially suitable for bilge or other applications where installation space is limited. The pump apparatus, including preferred embodiments thereof, is characterized by high pumping efficiency, long service life, compactness, and flexibility of assembly geometry whereby orientation of the top portion, the discharge means, and the base of the apparatus are variously alignable relative to one another.

5 Claims, 6 Drawing Figures

VERTICAL SHAFT IMPELLER PUMP APPARATUS

CROSS-REFERENCE

This application is a continuation of copending application Ser. No. 420,933, filed Dec. 3, 1973, now U.S. Pat. No. 3,861,831.

FIELD OF THE INVENTION

The present invention relates generally to pump apparatus and more particularly is concerned with vertical shaft impeller pumps.

In the liquid pumping arts, it is recognized that vertical shaft impeller pumps bear certain inherent advantages over their horizontal counterparts. One such advantage resides in the fact that vertical shaft pumps are generally smaller in their horizontal dimensions and are thus more amenable for use where horizontal installation space is restricted. Also, vertical shaft pumps generally will more readily pump to a lower depth than horizontal shaft pumps. On the other hand, vertical shaft pumps are generally considered to be somewhat deficient in service life as compared to their horizontal counterparts.

In accordance with the present invention, many improvements in vertical shaft impeller pumps have been achieved.

OBJECTS OF THE INVENTION

It is a principal object of the invention to provide vertical shaft impeller pump apparatus.

It is another object of the invention to provide vertical shaft impeller pump apparatus characterized by easy assembly and disassembly thereof.

It is another object of the invention to provide an electrically powered vertical shaft impeller pump apparatus wherein the respective orientation of the mounting base, power cable and discharge means is variable.

It is still another object of the invention to provide impeller pump apparatus wherein the portion containing all the moving parts can be removed without disturbing the installation.

It is another object of the invention to provide compact vertical shaft impeller pump apparatus adapted for mounting in small difficulty accessible sites.

It is still another object of the invention to provide impeller pump apparatus having exceptional pumping efficiency.

It is another object of the invention to provide impeller pump apparatus wherein substantial cooling of the prime mover is achieved by heat exchange with a fluid.

It is another object of the invention to provide vertical shaft impeller pump apparatus which normally does not require priming.

It is another object of the invention to provide vertical shaft impeller pump apparatus characterized by freedom from air binding.

It is another object of the invention to provide impeller pump apparatus comprising a novel self-centering, shaft-seal assembly.

It is still another object of the invention to provide a novel, readily assembled cable seal.

Other objects and advantages of the present invention will in part be obvious and will in part appear hereinafter.

SUMMARY OF THE INVENTION

The pump apparatus of the present invention broadly comprises (A) an external enclosure having fluid intake means located at the lower portion thereof; (B) a pumping chamber housing disposed within and spaced apart from said external enclosure, said housing having fluid inlet means located at the bottom thereof and fluid discharge means located near the top thereof; and (C) a fluid-tight motor casing containing therein a prime mover having a drive shaft which extends vertically through the bottom of said motor casing and is affixed to an impeller, said motor casing being disposed within and in spaced relationship to said housing so as to define therebetween an impeller chamber and an annular open flow passage extending from said impeller chamber to said fluid discharge means. The disposition of said annular flow passage around said motor casing results in cooling of the prime mover by the fluid being pumped and contributes greatly to improved service life of the prime mover. Where certain geometric relationships are provided, improved pumping efficiency is also realized.

THE DRAWINGS

FIG. 1 forming part hereof is a schematic, diagrammatic, partially sectional side view of the pump apparatus of the invention depicting several preferred embodiments thereof.

DETAILED DESCRIPTION OF THE INVENTION

Figure 1:
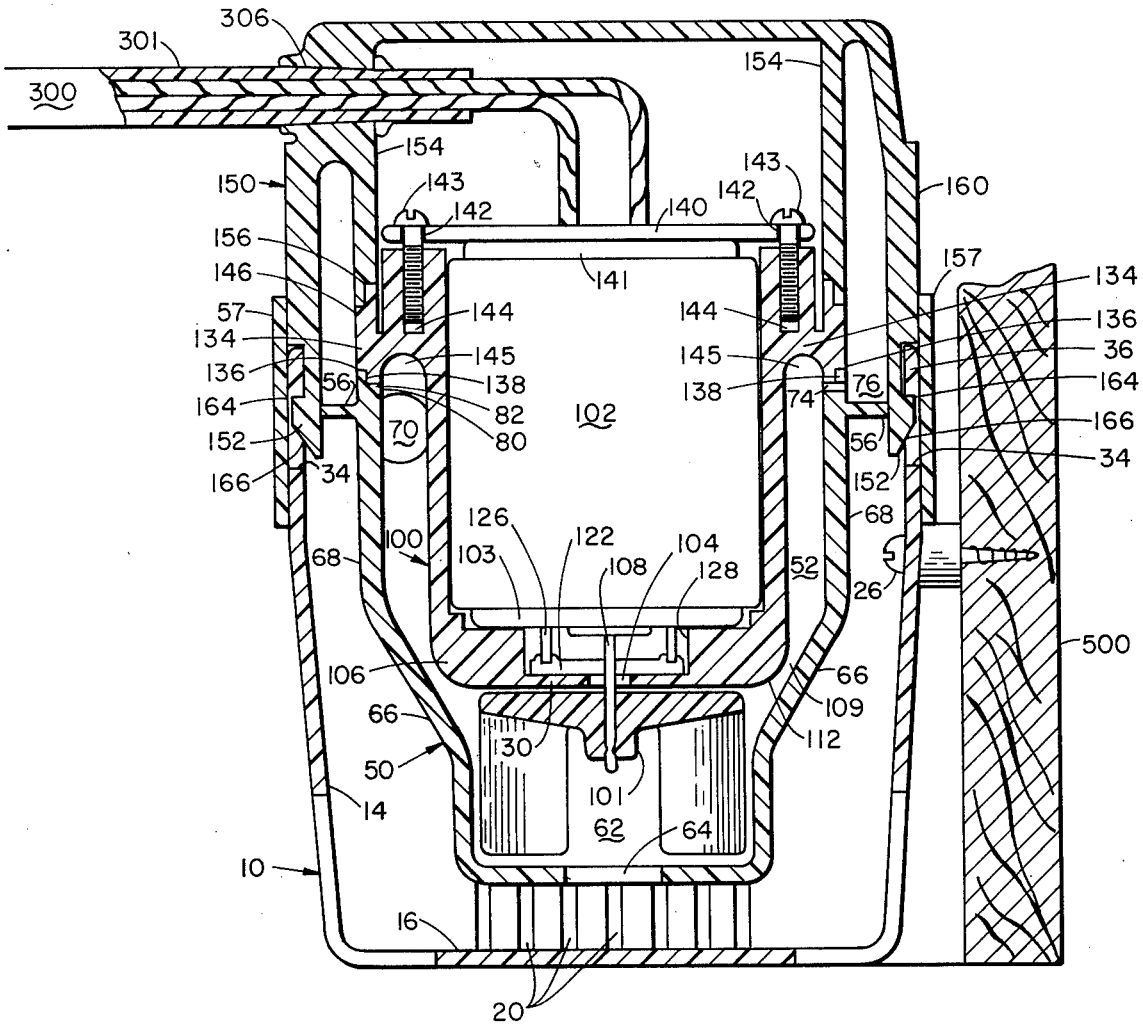

Referring now to the drawings, wherein like numerals refer to like structures, the pump assembly of the invention generally comprises base 10, pumping chamber housing 50, motor casing 100, and closure cap 150.

Base 10 is a generally cup-shaped member comprising sidewall 14, floor 16, and plurality of slots 20 provided at the lower portion and about the circumference. Preferably, the spacing and width of slots 20 are chosen so as to be large enough to permit full flow but small enough to strain out solid matter of sufficient size to constitute a jamming hazard.

As shown, base 10 is equipped with mounting means, such as one or more "U"-shaped channels 24, by which base 10 can be fastened to site 500 by means of fasteners 26. Alternatively, or, as preferred, additionally, one or more apertures 28 are provided in floor 16 by which base 10 can be fastened to a horizontal surface.

Figure 2:
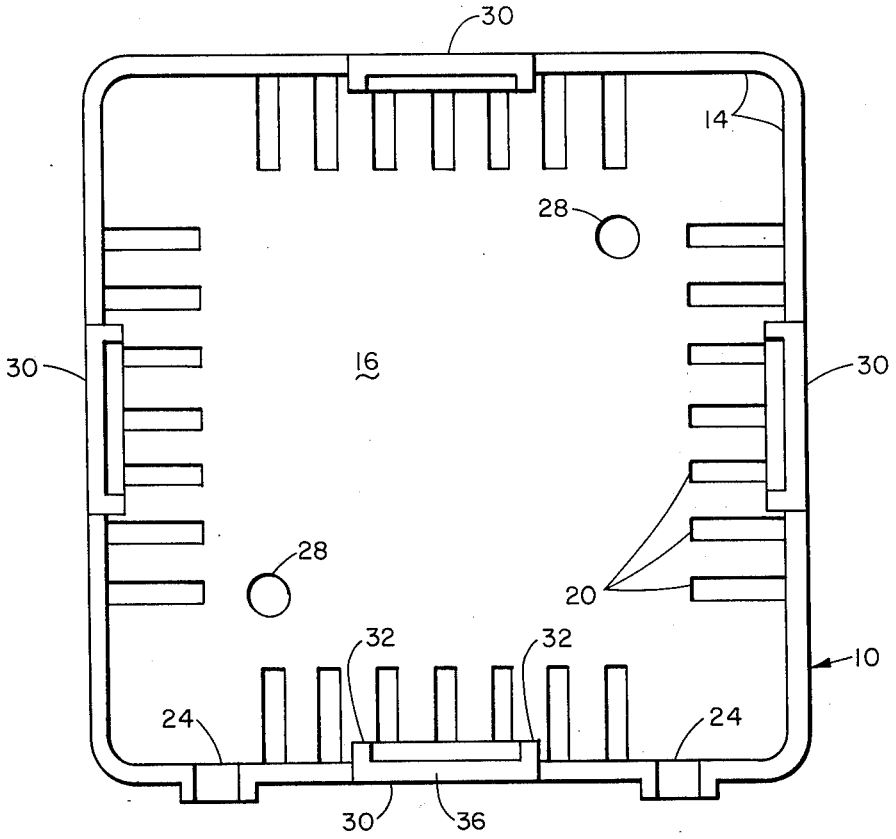
FIG. 2 is a schematic, diagrammatic top view of base 10 of FIG. 1.
Figure 3:
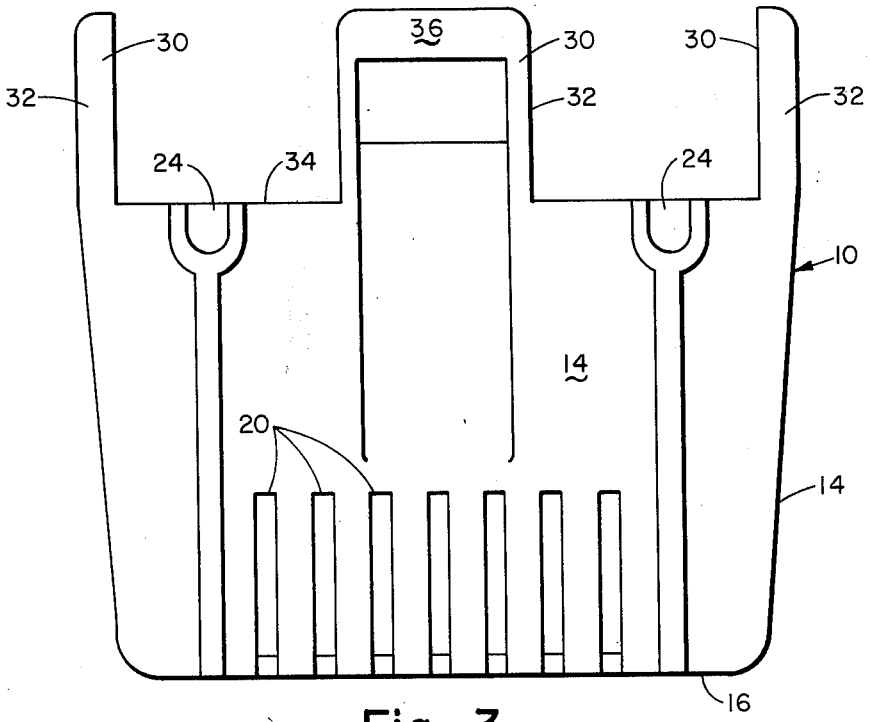
FIG. 3 is a schematic, diagrammatic side view of base 10 of FIG. 1.
Figure 4:
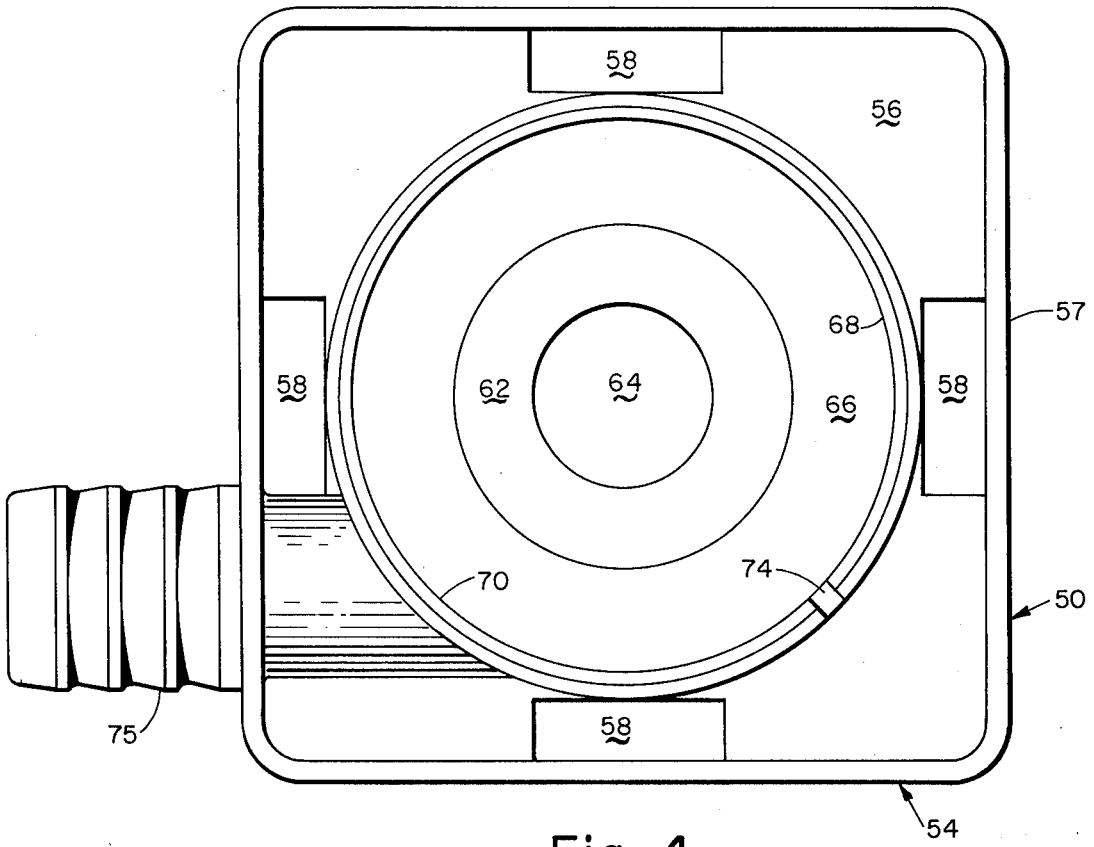
FIG. 4 is a schematic, diagrammatic top view of housing 50 of FIG. 1.
Figure 5:
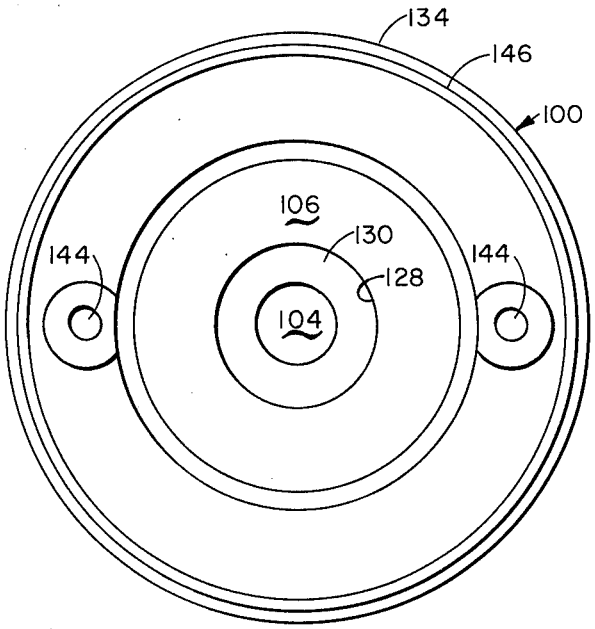
FIG. 5 is a schematic, diagrammatic top view of motor casing 100 of FIG. 1.
Figure 6:
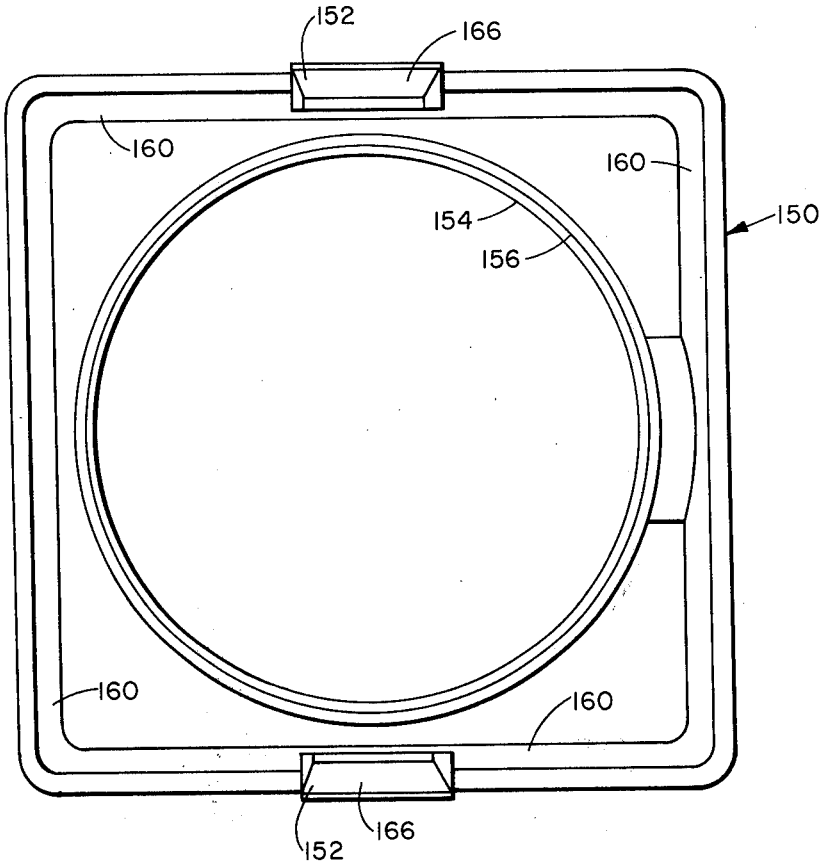
FIG. 6 is a schematic, diagrammatic bottom view of closure cap 150 of FIG. 1.

Base 10 is also equipped with interlocking means, which in combination with the cooperative interlocking means of cap 150, effectuate secure mating of the various elements of the pump assembly. In a preferred embodiment of the invention, referring now especially to FIGS. 2 and 3, said interlocking means comprise in part opposed pairs of inverted stirrups 30, each stirrup comprising spaced-apart pillars 32 extending upwardly from sidewall 14, and bridge 36 integral with and extending across pillars 32. While only a single pair of opposed stirrups 30 is necessary to interlock with a corresponding pair of lugs 152 located on cap 150, it is much preferred that at least two opposed pairs of stirrups 30 be provided, most preferably located symmetrically. In this way, cap 150 can be oriented independently of the orientation of base 10. This can be very important in the mounting of impeller pumps in the bilges of small boats or in other sites where mounting space is restricted. In the particular embodiment shown in the drawings, cap 150 and therefore power cable 300, can be oriented in any one of four positions relative to base 10. As will be explained in more detail hereinafter, it is also possible to employ the depicted interlocking arrangement and to vary the orientation of discharge nozzle 75. Thus employing the essentially square configuration, there are provided sixty-four different possible orientations with respect to each other of nozzle 75, cap 150, and base 10. Obviously, the above-described interlocking arrangement can be adapted to any base 10 having the cross-sectional geometry of an essentially regular polygon. Accordingly, base 10 need not necessarily be of square cross-section, but can also be hexagonal, pentagonal, octagonal or, the geometric ultimate of regular polygons, circular.

Pumping chamber housing 50 comprises a generally cup-shaped chamber 52 and integral support member 54 adapted to maintain housing 50 in a generally centered and spaced-apart position within base 10. Member 54 comprises web 56 extending laterally from enclosure 68 to vertically oriented flange 57, the lower portion of which nests over upper margin 34 of base 10. Web 56 is provided with apertures 58 located so as to receive stirrups 30 therethrough. Chamber 52 comprises a cylindrical impeller chamber 62, provided with inlet 64 located at the center of the bottom thereof. Commencing near the top of chamber 62, sidewall 66 extends upwardly in a divergently tapered manner and transitions into generally cylindrical enclosure 68 having a greater internal diameter than the outside diameter of motor casing 100, thereby establishing an open annular flow passage. Located near the upper portion of enclosure 68, is tangentially oriented discharge orifice 70. In a preferred embodiment of the invention, small aperture 74 is provided through enclosure 68, said aperture serving to conduct fluids, and particularly gases, which might otherwise be entrapped, into relief chamber 76. Thus, aperture 74 serves to assure self-priming and to mitigate against air binding.

Motor casing 100 comprises a generally cylindrical cup-shaped enclosure adapted to receive in close-fitting relationship prime mover 102, such as an electric motor. Aperture 104 located in bottom 106 of casing 100 allows drive shaft 108 to pass into impeller chamber 62. Aperture 104 is provided with sealing means adapted to prevent entry of fluids into casing 100.

While substantially any sealing means can be employed, the arrangement depicted in FIG. 1 of the drawings is preferred because said arrangement is essentially self-centering which eases assembly and increases life and reliability. Thus, the preferred arrangement comprises the combination of at least one wafer 122 formed of resilient material, compression ring 126, and means to urge compression ring 126 downwardly with sufficient force to cause circumferential impingement of wafer 122 against shoulder 130. In assembly, wafer 122, which is of greater outside diameter than the diameter of aperture 104 and of smaller outside diameter than the diameter of aperture 128, is placed in aperture 128 thereby to rest on shoulder 130. Next, compression ring 126 which is of greater outside diameter than the diameter of aperture 104 and of smaller outside diameter than the diameter of wafer 122 is placed in aperture 128. While compression ring 126 can be separate and distinct from prime mover 102, it is much preferred that compression ring 126 be integral with end cap 103 of prime mover 102. Shaft 108 is inserted through wafer 122 and prime mover 102 is inserted into casing 100. In the course of said insertion, shaft 108 and wafer 122 will self-center with respect to each other. Also compression ring 126 will urge wafer 122 downwardly and in sealing relationship with shoulder 130. The means by which prime mover 102 is urged downwardly is not particularly critical provided that sufficient force is exerted to cause compression ring 126 to create sufficient deformation of wafer 122 to in turn create a continuous 360° seal. A convenient arrangement for the application of such requisite force is provided by bar 140 which crosses over upper end 141 of prime mover 102 and which bar 140 is provided with apertures 142 through which fasteners 143 can be inserted. Corresponding fastener receiving holes 144 are provided and the downwardly directed thrusting force can be applied simply by torquing down fasteners 143. Upon completion of assembly of prime mover 102 into casing 100, impeller 101 is affixed to shaft 108.

Wafer 122 is composed of a fluid-impervious, resilient material and accordingly, many natural and synthetic plastomers and elastomers are suitable for use. Due to their inert character and high temperature characteristics and due to the fact that they possess excellent lubricity, we have found that solid polymers of tetrafluoroethylene constitute generally excellent materials of choice. Obviously, more than one such wafer can be employed if desired.

Completing the discussion of casing 100, means are provided for maintaining casing 100 properly positioned within housing 50. Such suitable means can comprise a laterally extending circumferential flange 134 located on casing 100. In turn, lower margin 136 of flange 134 is adapted to engage upper margin 80 of housing 50 so as to maintain casing 100 and housing 50 in spaced-apart coaxial relationship to one another. This relationship can be achieved by providing lower margin 136 with stepped cross-sectional contour 138 and providing upper margin 80 with corresponding receiving contour 82. Preferably a sealant is utilized between contours 138 and 82 because the capacity of the pump is improved by as much as 25% when a sealant is utilized.

Another important preferred embodiment of the invention is represented by space 145 provided at the uppermost limits of chamber 52, which space 145 rises to a level somewhat above the top of orifice 70 and, if employed, aperture 74. Space 145 serves to ensure a substantially complete fill of orifice 70. Space 145 can be conveniently provided as an arcuately shaped circumferential channel in the lower surface of flange 134.

The principal functions of cap 150 are to form a fluid-tight enclosure with casing 100, thereby to isolate prime mover 102 from contact with fluids, and in particular liquids, and to provide interlocking means in the form of lugs 152 which, in combination with stirrups 30 on base 10, provide for secure assembly of the various parts of the apparatus. With respect to the first of these functions, cap 150 comprises inner wall 154 with edge 156 being adapted to engage in fluid-tight relationship with upper edge 146 of flange 134. Desirably, a continuous adhesive bond is provided between edges 156 and 146, such as by cementing, welding, soldering or solvent bonding thereof.

The interlocking function of cap 150 is served by generally extending outer walls 160 and providing thereon outwardly biased locking lugs 152 projecting downwardly therefrom. Easy assembly is provided for because of chamfered lower surface 166 on each lug. As chamfered surface 166 is forced over corresponding bridge 36, notch 164 of lug 152 engages with bridge 36 and effectuates interlocking.

Communication of prime mover 102 with an external power supply (not shown) is provided by cable 300 through the wall of cap 150. While any suitable means for achieving fluid-tight seal between cable 300 and cap 150 can be employed, the present invention includes a sealing arrangement which is possessed of simplicity, and ease and rapidity of assembly. Said arrangement comprises a combination of structural features relating to both orifice 306 through which cable 300 passes, and the structure of cable 300. Orifice 306 comprises a shallow conical aperture through the wall of cap 150, the smaller diameter of said orifice being toward the interior of cap 150. Typically, cable 300 comprises at least two conductors each conductor bearing a relatively thin insulative coating thereover. Generally speaking, it has been found that multistranded conductor wire is entirely suitable. Completing cable 300, there is provided a smooth, resilient and relatively thick insulative covering 301. For the purposes of the present invention, the thickness of covering 301 should be sufficient to allow for substantial compression without cutting through the diameters of the conductors or their insulative coatings. While substantially any essentially fluid-impervious plastomeric or elastomeric resilient material can be employed as covering 301, it has been found that urethane represents an excellent choice since it is readily processed, tends to produce smooth surfaces and is highly impervious and inert.

The diameter of cable 300 relative to the diameter of orifice 306 is also important in achieving a fluid-tight seal. The diameter of cable 300 should be at least slightly smaller than the largest diameter of orifice 306 but at least 0.020, and preferably 0.030, inch greater than the smallest diameter of orifice 306. It has been found, for example, that a good seal is achieved by use of a cable having an O.D. of 0.250 inch and an orifice having a largest diameter of 0.270 and a smallest diameter of 0.220 inch.

In assembling, it is merely necessary to force cable 300 through the large diameter end of orifice 306 which acts to deform covering 301 to a diameter sufficiently small to allow passage of cable 300 through the smaller end of orifice 306. Upon exit of cable 300 from the smaller end of orifice 306, covering 301 recovers at least a portion of its original diameter, thereby becoming larger than said smaller end, effectuating a fluid-tight seal therewith, and rendering pull-out extremely difficult and unlikely.

Turning now to a typical operation, upon submerging the pump into a body of liquid, such as in the bilge of a boat, liquid will enter through slots 20 and will fill chambers 62 and 52. Priming is eased by the presence of aperture 74 which vents gases which might otherwise become entrapped. With the activation of prime mover 102, impeller 101 rotates and forces liquid upwardly and eventually through discharge orifice 70. As is apparent, the liquid flowing through the annular passage 52 between casing 100 and housing 50 establishes an indirect heat exchange relationship with prime mover 102 by passage of heat through casing 100. Even when liquid is exhausted, air passing through said passage helps to cool casing 100. This heat exchange relationship represents a very great advantage of the invention and contributes substantially to improvement in the operating life of the prime mover, particularly where long term heavy duty operating cycles are encountered.

In order to achieve the high pumping efficiency advantages of which the pump apparatus of the invention is capable, however, it is important that sidewall 66 pass in close proximity to outer corner 112 of casing 100, thereby rendering the cross-sectional area of transition annulus 109 relatively small, and creating a venturi. Further, by employing the preferred embodiments of this invention wherein there are provided space 145 and aperture 74, the incidences of non-priming and air-binding phenomena are dramatically reduced.

Obviously, any materials of construction can be employed which are capable of withstanding the intended and obvious working environments encountered in impeller pump applications. However, it should be noted that the pump housing assembly of the invention is especially adapted to fabrication from thermoplastic materials such as polyamides, polyolefins, polystyrene, polycarbonates, polyacetals, etc. The so-called "impact" resistant polymers based on acrylonitrile-butadiene-styrene copolymers have been found to be particularly useful. Further in a favor of the use of thermoplastic polymers is the fact that the relatively complex forms of the elements of the invention are ordinarily amenable to fabrication by standard thermoplastic forming techniques, particularly by injection molding.

Obviously, many changes can be made in the above detailed description of the invention without departing from the intended and essential spirit thereof. Accordingly, the embodiments specifically described hereinbefore are to be considered in all respects as illustrative and non-limiting.

What is claimed is:

1. A vertical shaft impeller pump comprising:

A. an external enclosure comprising intake means adapted to conduct fluid thereinto;

B. a separable, generally cup-shaped housing disposed within and spaced apart from said external enclosure and comprising i. inlet means adapted to conduct fluid from within said external enclosure into said housing, said inlet means being located at the lower portion of said housing, and ii. discharge means adapted to conduct fluid from said housing to the exterior of the pump;

C. a separable fluid-tight casing disposed within and in spaced relationship with said housing, said spaced relationship defining an impeller chamber below said casing;

D. a prime mover disposed within said casing, said prime mover comprising a drive shaft extending in substantially fluid-tight relationship through the bottom of said casing and into said impeller chamber; and E. an impeller disposed within said impeller chamber and affixed to said drive shaft.

2. The pump of claim 1 wherein:

i. said external enclosure comprises separable, substantially cup-shaped lower and upper members, said lower and upper members each having the cross-sectional geometry of a regular polygon, and said lower and upper members comprising cooperative interlocking means on at least two sides thereof; and ii. said housing comprises web means having apertures therethrough corresponding to and adapted to receive said interlocking means.

3. The pump of claim 2 wherein:

i. each of said upper and lower members of said external enclosure have a square cross-sectional geometry; and ii. one of said members is provided with symmetrically oriented interlocking means on each of the four sides thereof; and iii. at least two opposed sides of the other of said members are provided with corresponding cooperating interlocking means.

4. The pump of claim 1 wherein said fluid-tight relationship between said drive shaft and said casing is provided by the combination of:

i. a generally cup-shaped casing having an aperture through the bottom thereof;

ii. at least one resilient elastomeric or plastomeric wafer seal located within and at the bottom of said casing, said wafer seal having a diameter substantially greater than the diameter of said aperture and smaller than the diameter of the bottom of said casing, and said wafer seal having an aperture therethrough adapted to receive said drive shaft in fluid-tight rotating relationship therewith;

iii. a compression ring resting upon said wafer seal and having an outside diameter greater than the diameter of said casing aperture and smaller than the diameter of said wafer seal; and iv. means to compress said compression ring against said wafer seal with sufficient force to cause substantially continuous 360° impingement of said wafer seal against the bottom of said casing to result in the establishment of a fluid-tight relationship therewith.

5. The pump of claim 4 wherein said compression ring is integral with and extends downwardly from said prime mover.

* * * * *